US006149400A

United States Patent [19]

Samland et al.

[11] Patent Number: 6,149,400

[45] Date of Patent: Nov. 21, 2000

[54] METHOD AND APPARATUS FOR A SUCTION VALVE OF THE PLATE-TYPE CONSTRUCTION

[75] Inventors: Georg Samland, Öhningen, Germany; Christian Keller, Frauenfeld, Switzerland

[73] Assignee: Maschinenfabrik Sulzer-Burckhardt, Basel, Switzerland

[21] Appl. No.: 09/051,077

[22] PCT Filed: Oct. 1, 1996

[86] PCT No.: PCT/CH96/00340

§ 371 Date: Apr. 1, 1998

§ 102(e) Date: Apr. 1, 1998

[87] PCT Pub. No.: WO97/13068

PCT Pub. Date: Apr. 10, 1997

[30] Foreign Application Priority Data

Oct. 3, 1995 [EP] European Pat. Off. ..... 95810621

[51] Int. Cl.[7] ..... F04B 49/00

[52] U.S. Cl. ..... 417/298; 417/505; 137/516.13; 251/129.01

[58] Field of Search ..... 417/298, 505, 417/569; 137/516.13; 251/129.01

[56] References Cited

U.S. PATENT DOCUMENTS

| | | | |
|---|---|---|---|
| 5,052,434 | 10/1991 | Bauer | 137/516.13 |
| 5,349,986 | 9/1994 | Sullivan et al. | 251/129.01 |

FOREIGN PATENT DOCUMENTS

| | | |
|---|---|---|
| 679714 | 8/1939 | Germany . |
| 1251121 | 9/1967 | Germany . |
| 2302250 | 8/1974 | Germany . |

*Primary Examiner*—Charles G. Freay
*Attorney, Agent, or Firm*—Townsend and Townsend and Crew LLP

[57] ABSTRACT

Method for the stepless regulation of the delivery of a suction valve of the plate-type of construction, comprising a valve plate which is actuated by an electromagnet arranged in a valve catcher, wherein the electromagnet is so controlled that, in a first control phase (11*a*), the valve plate (3) firmly contacts the valve catcher (6), or a damper plate (4) arranged between the valve catcher (6) and the valve plate (3) and is blocked, and that, in a second control phase, the electromagnet (9) is controlled by a decaying alternating current, in order to demagnetise the valve plate (3), so that the valve plate is released.

21 Claims, 4 Drawing Sheets

METHOD AND APPARATUS FOR A SUCTION VALVE OF THE PLATE-TYPE CONSTRUCTION

This application is a 371 of PCT/CH96/00340 filed Oct. 1, 1996.

BACKGROUND OF THE INVENTION

1. Field of the Invention

The invention relates to a method of operating a suction valve of the plate-type of construction comprising a valve plate actuated by an electromagnet.

2. Description of the Prior Art

An electromagnetically controlled suction valve of the plate-type of construction is known from the patent specification DE-679 714. There, the valve plate serves as an armature of an electromagnet, so that the position of the valve plate can be determined by a control of the magnet coil. This known suction valve has the disadvantage that the valve plate has the tendency to stick to the magnetic yoke of the electromagnet which does not permit any reliable, and in particular rapid operation of the suction valve. Furthermore, it is necessary to arrange a magnetic insulation relative to the valve seat, in order to prevent the valve plate serving as an armature sticking at the valve seat. This magnetic insulation has the disadvantage that the application is costly and that the blows brought about by the valve plate bring about substantial wear of the magnetic insulation which greatly shortens the servicing interval for the suction valve.

SUMMARY OF THE INVENTION

It is the object of the present invention to propose a more economical suction valve which is better controllable.

This object is in particular satisfied with a method wherein the valve plate is held by an electromagnet arranged in the catcher, and wherein the electromagnet is controlled with a decaying alternating current for the release of the valve plate, in order to at least partly demagnetize the valve plate, so that the valve plate is reliably released from the valve catcher and does not stick to the valve seat. The apparatus of the invention has a valve catcher with a magnet coil, and also a control device in order to control the magnet coil, and, in particular, to supply it with a decaying alternating current.

DETAILED DESCRIPTION OF THE PREFERRED EXEMPLARY EMBODIMENTS

Figure 1:
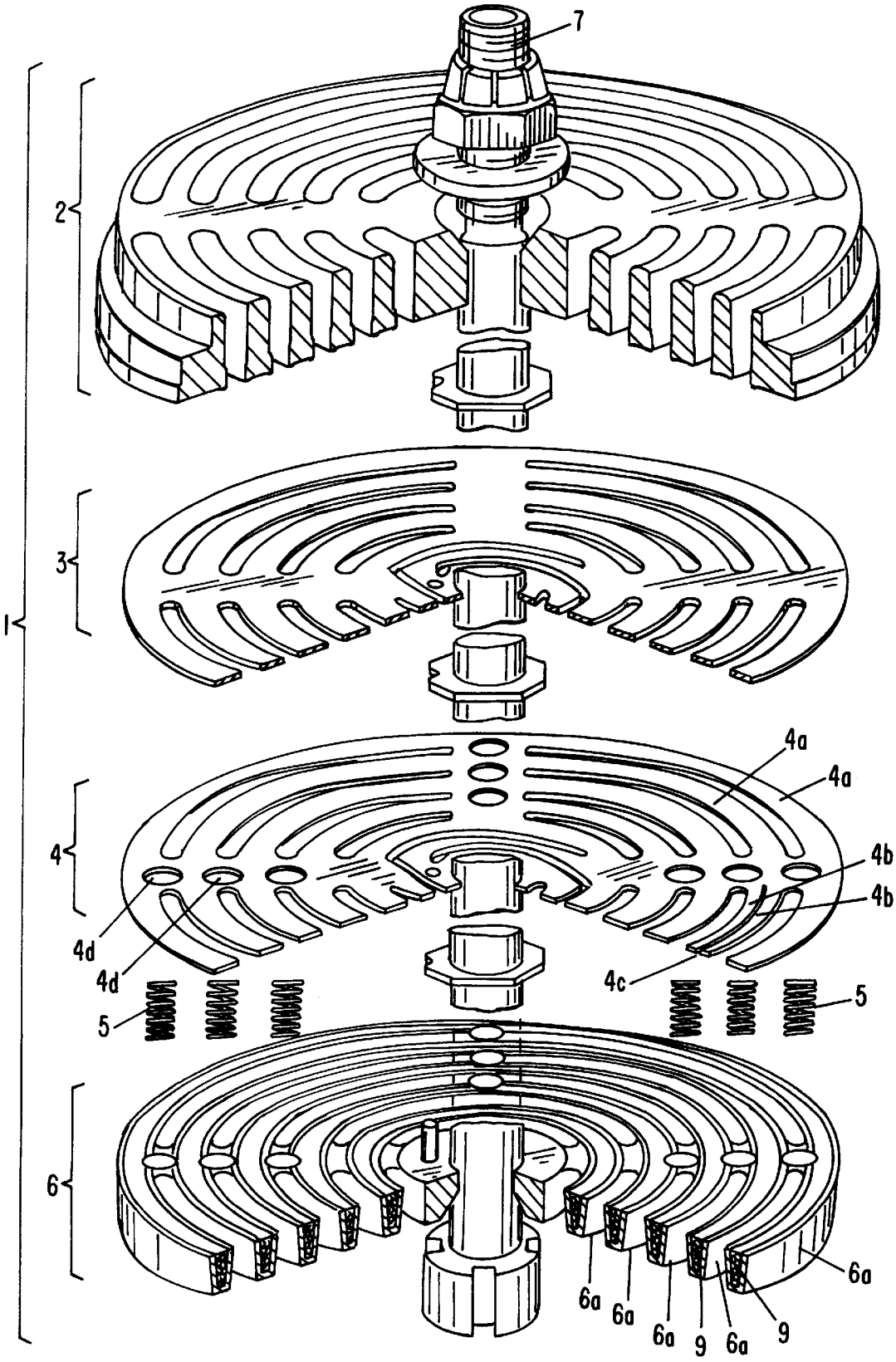
FIG. 1 is an exploded drawing of a suction valve with the plate-type of construction.

FIG. 1 shows in an exploded drawing a suction valve 1 comprising a valve seat 2 which is also termed a valve seat plate, a valve plate 3, a damper plate 4 and a catcher 6. These parts are held together by a common central screw 7. The damper plate 4 has openings 4*d* for the passage of a spring 5 which is arranged to act between the catcher 6 and the valve plate. The suction valve 1 can also be operated with, or also without, a damper plate 4. The valve catcher 6 has a plurality of ring bodies 6*a* which are all connected together. Each ring body 6*a* has a groove 6*b* extending in the circumferential direction, with electrical conductors being arranged in the ring groove 6*b* and forming a magnet coil 9.

Figure 3A:
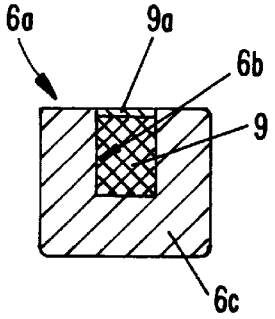
FIG. 3*a* is a cross-section through a ring body of the valve catcher.

FIG. 3*a* shows a cross-section through a ring body 6*a* with the ring groove 6*b,* so that the ring body 6*a* adopts the shape of a yoke 6*c* of a ring body magnet. A magnet coil 9 is arranged in the ring groove and forms an electromagnet. The ring body 6*a* in accordance with embodiment of FIG. 3*a* has a cover layer 9*a* at the side facing the valve plate 3 which hermetically seals off the inner space occupied by the magnet coil relative to the outside, in order to protect the magnet coil 9 from contamination or noxious gases. The magnet coil 9 is controlled by a control device 8, so that a magnetic field is formed and the valve plate 3 is attracted by this magnetic field. The valve plate 3 forms the armature of the electromagnet.

Figure 2:
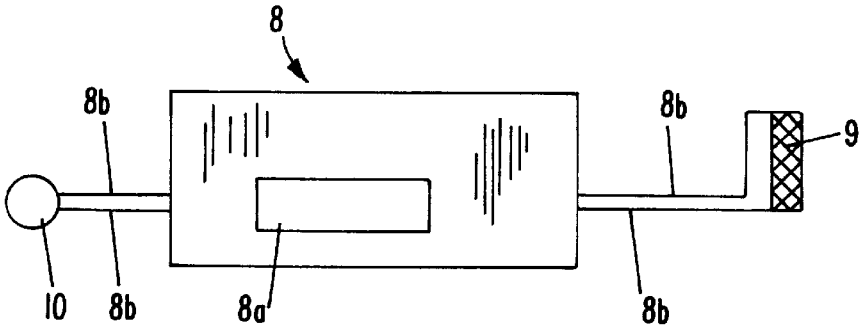
FIG. 2 is an electronic control device.

FIG. 2 shows the control device 8 which has a modulation device 8*a,* with the control device being connected via electrical lines 8*b* to an angle of rotation sensor and via further electrical lines 8*b* to the magnet coil or magnet coils 9.

Figure 4:
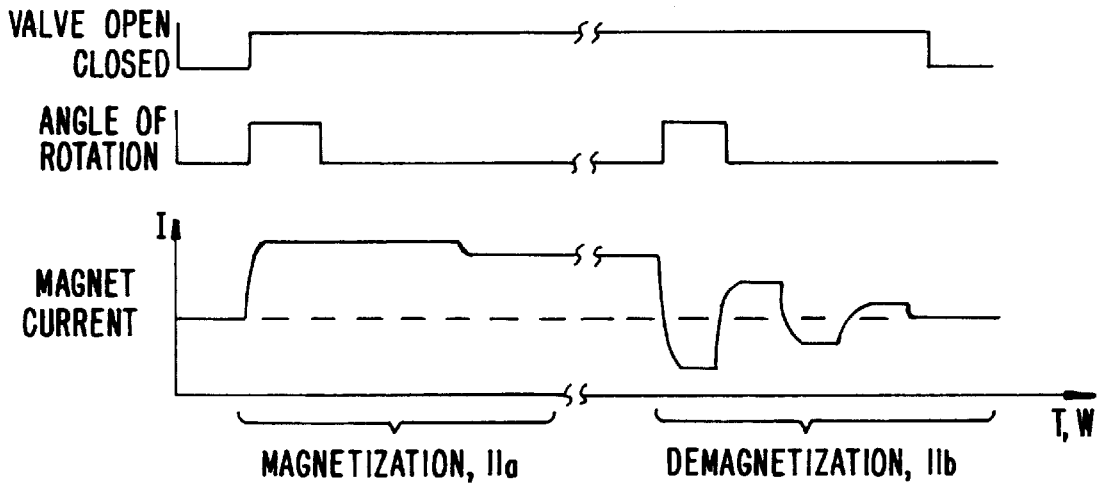
FIG. 4 is a control diagram for a suction valve of the plate-type of construction.

In FIG. 4 there is shown a schematic course of the measurement signals processed by the control device 8 and of the control signals that are generated. Time t or the angle of rotation ω of the piston compressor are shown on the horizontal axis. In the uppermost diagram, the position of the valve is shown in the two operating states open and closed, in the middle diagram there is shown an angle of rotation signal from the angle of rotation sensor, and in the lower diagram there is shown the magnet current I transmitted by the control device 8 to the magnet coil. A magnetization current is applied to the coil 9 in response to a signal of the angle of rotation transducer 10 and causes the valve plate 3 to be attracted by the valve catcher 6, so that the valve is open. During this, the control device 8 executes a first control phase 11*a* which brings about a magnetization of the valve catcher 6. The suction valve 1 can now be held open over a time period which can be selected as desired. The signal of the angle of rotation sensor 10 is again preferably used for the closing of the suction valve 1, with the control device 8 introducing after this signal a second control phase 11*b* of the electromagnet 9 wherein a decaying alternating current which is supplied to the magnet coil 9 is produced by means of a modulation device 8*a*, in order to demagnetize the valve plate 3 and/or the valve catcher 6. Through the demagnetization any form of holding force between the valve plate 3 and the valve catcher 6 is prevented. In particular, sticking together of the two parts as a result of residual magnetic forces is prevented. On closing of the suction valve 1, the valve plate 3 is pressed against the valve seat 2. During this, the valve plate 3 comes directly into contact on the valve seat 2, so that a direct contact exists between the two metallically formed components. As the valve plate 3 was previously demagnetized, there is no danger of the valve plate 3 sticking to the valve seat 2. The valve seat 2, the valve plate 3, and the valve catcher 6 customarily consist of a stainless steel with hard magnetic characteristics. No magnetically insulating materials are arranged between the valve seat 2, the valve plate 3, and the valve catcher 6, so that the demagnetization of the valve plate 3 and of the valve catcher 6 is advantageous in order to ensure fault-free operation of the suction valve 1. The control method of the invention for the magnet coil 9 with a modulation device 8*a* for the demagnetization has, moreover, the advantage that the demagnetization can be carried out in a very short period of time, which enables very rapid switching times of the suction valve 1. The suction valve 1 is, in particular, controllable in such a way that during a predetermined number of rotations, for example of a compressor, the valve 1 can be kept open and can be operated during a further arbitrarily selectable number of rotations in an automatic opening and closing working mode. Thus, it is possible to steplessly regulate the delivery quantity of the suction valve 1.

Figure 5:
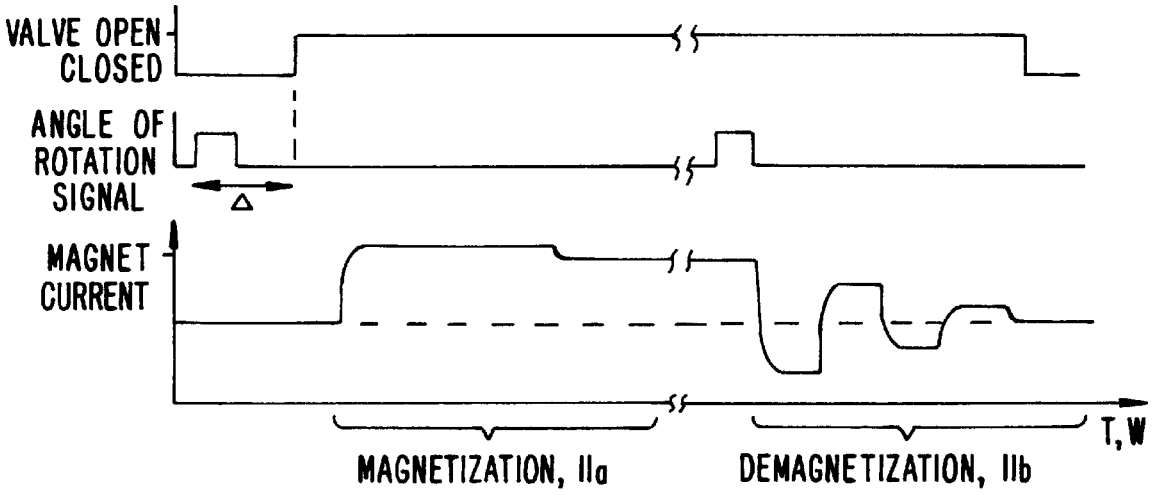
FIG. 5 is a control diagram for a further method of controlling a suction valve of the plate-type of construction.

FIG. 5 shows a further schematic course of a control method, and also the position of the valve 1. The elaspsed time t, or the angle of rotation ω of a piston compressor which is equivalent to the time, is shown on the horizontal axis. The angle of rotation signal is measured with the angle of rotation sensor 10. The operating behavior of the suction valve 1 in conjunction with a piston compressor is known. In particular, it is known that after a fixed angle of rotation Δ relative to the angle of rotation signal, the valve is completely open and the valve plate 3 contacts the valve catcher 6. The magnet coil 9 is then first activated by the control device 8 with a magnet current I in a first control phase 11*a,* when the valve 1 is fully open and the valve plate 3 contacts the valve catcher 6. In this way, the valve plate 3 can be very reliably held with a relatively low magnetic force. During an automatic operation of a piston compressor, a valve plate 3 contacts the valve catcher 6 during an angle of rotation of, for example, 120 degrees.

After an angle of rotation signal, a decaying alternating current is then supplied to the magnet coil 9 by the control device 8 in a second control phase 11*b,* where it is ensured that the total second control phase 11*b* will take place in a range of angular rotation in which the valve plate 3 would contact the valve catcher 6 during automatic operation. In this way, the valve plate plate 3 is not prematurely separated from the range of influence of the magnet coil 9 during the second control phase 11*b* and the valve plate 3 can be fully demagnetized.

The suction valve 1 of FIG. 1 can be equipped with or without a damper plate 4. The control method of FIG. 5 was described for a suction valve 1 without a damper plate 4. Should the suction valve 1, however, also have a damper plate 4, then in the control method of FIG. 5 the damper plate 4 is arranged between the valve plate 3 and the valve catcher 6, so that with the fully open valve 1, the damper plate 4 contacts the valve catcher 6 and the valve plate 3 contacts the damper plate 4. Otherwise nothing changes with respect to the control method.

Figure 3D:
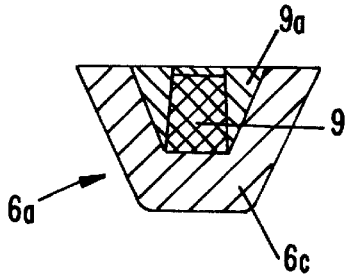
FIG. 3*d* is a cross-section through a further embodiment of a ring body of a valve catcher.
Figure 3B:
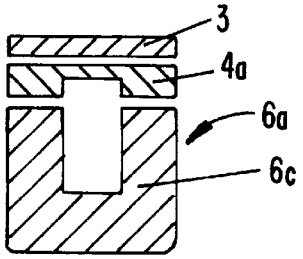
FIG. 3*b* is a further cross-section through a ring body of a valve catcher with a damper plate and a valve plate.

FIG. 3*b* shows a further cross-section through a ring body 6*a* formed as a yoke 6*c* of a ring body magnet. In this illustrated embodiment, the suction valve has a damper plate 4, with the damper plate 4 consisting of a plurality of ring bodies 4 which are connected together as shown in FIG. 1. The ring body 4*a* is designed in accordance with the embodiment 3*b* in such a way that the side facing the yoke 6*c* of the ring body magnet is of U-shape. This design causes the magnetic flux to increasingly flow via the valve plate 3, whereby the valve plate 3 can be better attracted by the magnet coil 9.

Figure 3C:
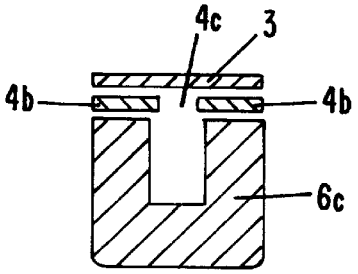
FIG. 3*c* is a further cross-section through a ring body of a valve catcher with a damper plate and a valve plate.

FIG. 3*c* shows a further embodiment of a suction valve 1 with damper plate 4. In order to improve the magnetic flux between the yoke 6*c* of the ring body magnet and the valve plate 3, the ring body 4*a* of the damper plate 4 has a gap 4*c* while forming two ring body parts 4*b* as illustrated in FIG. 1. The gap 4*c* advantageously extends concentrically to the central screw 7.

FIG. 3*d* shows a further cross-section through a ring body 6*a* with the yoke 6*c* of the ring body magnet being of V-shaped design, so that the whole magnet coil 9 is embedded in an insulating cover layer 9*a*.

For the operation of the suction valve 1, at least a single magnet coil 9 arranged in the valve catcher 6 is necessary. A plurality of magnet coils 9 arranged in the concentrically extending ring bodies 6*a* is advantageously used in order to bring about a greater force on the valve plate 3. These magnet coils 9 can be controlled by the control device 8 in such a way that all the magnet coils generate a magnetic field extending with the same polarity, or also in such a way that adjacently disposed magnet coils generate a magnetic field of opposite polarity. The apparatus of the invention for the actuation of a valve plate 3 of the suction valve of the plate-type of construction 1 includes at least one valve catcher 6, and also an electronic control device 8. This apparatus can be assembled together with a valve seat 2, a valve plate 3 and also spring elements 5 into a suction valve 1. In this respect, the apparatus of the invention is also suitable for already existing suction valves in order to convert these into a controllable suction valve 1. In this respect, the existing valve catcher 6 is replaced by the valve catcher 6 with magnet coils 9 as shown in FIG. 1 and the magnet coils connected to the control device 8. Thus, an existing suction valve 1 can be modified in a simple and cost favorable manner. The apparatus of the invention and the suction valves 1 find uses, in particular with piston compressors. The apparatus of the invention makes it possible to steplessly change and regulate the delivery quantity of each individual compressor space of a piston compressor independently of the other compression spaces.

Figure 6:
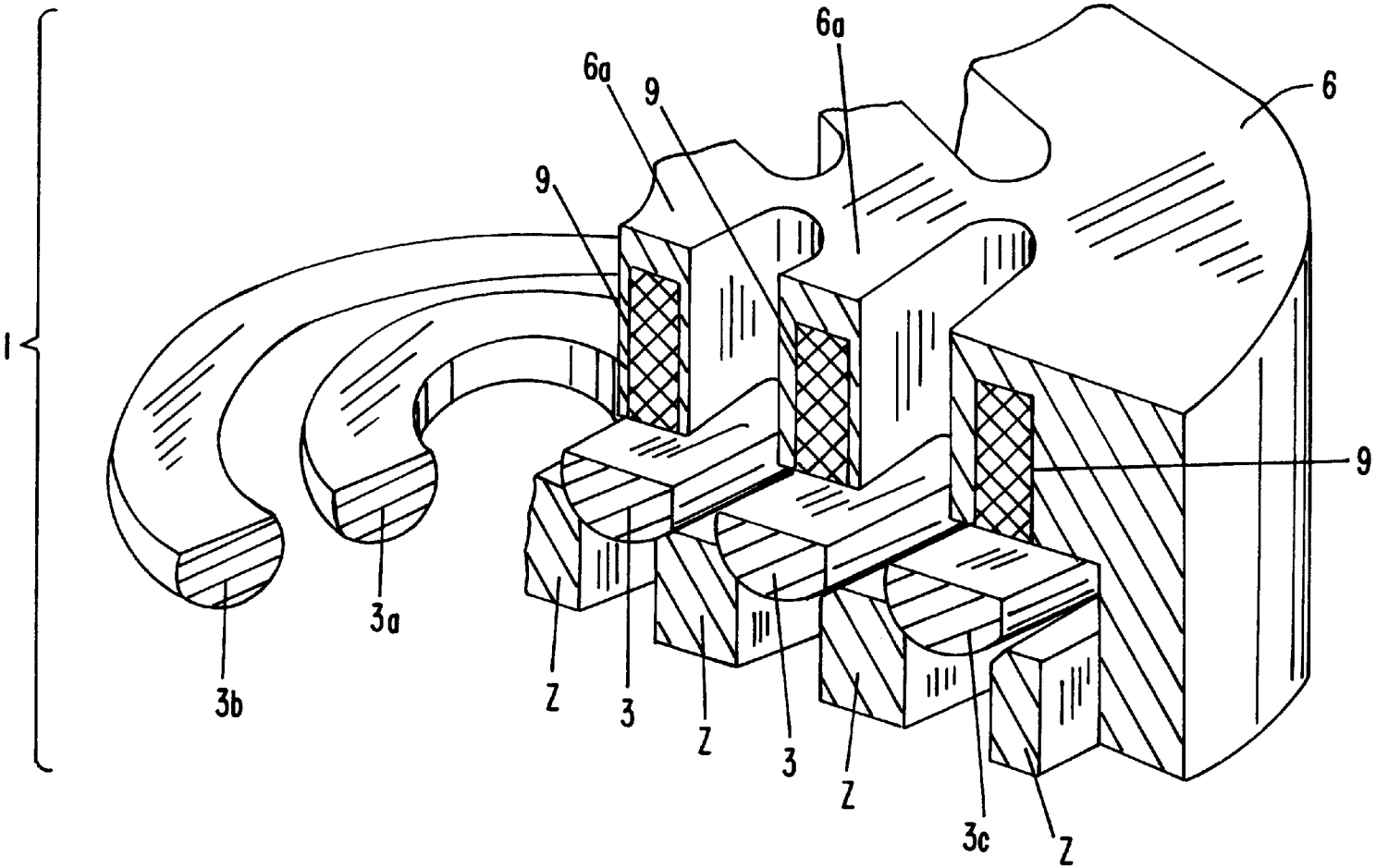
FIG. 6 is a further embodiment of a suction valve with a valve plate consisting of a plurality of ring-shaped valve plate parts.

FIG. 6 shows a further embodiment of a suction valve 1 comprising a valve seat 2 and a valve plate 3, with the valve plate 3 consisting of a plurality of individual concentrically disposed ring-like valve plate parts 3*a,* 3*b* and also a catcher 6 with magnet coils 9 arranged in the ring body 6*a* of the catcher 6. The springs 5, which press the valve plate parts 3*a,* 3*b* against the valve seat 2 in the rest position, are not illustrated. On actuating the magnet coils 9, the valve plate parts 3*a,* 3*b*, 3*c* respectively disposed beneath the coil 9 are attracted by the U-shaped ring body 6*a* lying above it. The magnet coils 9 are jointly controllable (energizable), so that all valve plate parts 3*a,* 3*b*, 3*c* are operable reacting in the same sense. The magnet coils 9 are also controllable such that the one valve plate parts 3*a,* 3*b*, 3*c,* for example the valve plate parts 3*a,* 3*b* are held at the valve catcher 6 by the actuation of the magnet coil 9, while the valve plate part 3*c* opens and closes with normal mobility, since the magnet coil 9 arranged above the valve plate part 3*c* is not activated.

The valve plate parts 3*a*, 3*b*, 3*c* are manufactured from a ferromagnetic material, such as iron, or of a ferromagnetic plastic, or of a plastic containing a ferromagnetic metal.

What is claimed is:

1. A method for the stepless regulation of delivery of a suction valve of a plate-type of construction comprising a valve plate, an electromagnet arranged in a valve catcher and a damper plate arranged between the valve catcher and the valve plate, the method comprising:

actuating the valve plate with the electromagnet;

controlling the electromagnet in a first control phase such that the valve plate firmly contacts one of the valve catcher or the damper plate such that the valve plate is blocked; and controlling the electromagnet in a second control phase by a decaying alternating current such that the valve plate is at least partly demagnetized thus releasing the valve plate.

2. A method in accordance with claim 1 further comprising activating the electromagnet when the valve plate is located in an open state.

3. A method in accordance with claim 2 wherein the electromagnet is only activated or deactivated when the valve plate contacts the valve catcher one of either directly or together with the damper plate.

4. A method in accordance with claim 1 wherein the electromagnet is controlled such that the valve plate remains open for a predetermined number of cycles of a compressor and is operated free-running over a predetermined number of cycles without the action of the electromagnet.

5. A method in accordance with claim 1 wherein the valve plate consists of a plurality of valve plate parts arranged concentric to one another that are individually or jointly controlled by the electromagnets.

6. An apparatus for the actuation of a valve plate of a suction valve of plate-type construction, the apparatus comprising a valve catcher and an electronic control device, wherein the valve catcher is formed of a ring body that has a ring groove extending in the circumferential direction and also a magnet coil arranged in the ring groove such that the ring body forms a yoke of a ring body magnet of an electromagnet, wherein the magnet coil is connected to the control device in order to attract the valve plate forming an armature of the electromagnet, and wherein the electromagnet is controlled during, a control phase by a decaying alternating current such that the valve plate is at least partly demagnetized.

7. An apparatus in accordance with claim 6 wherein the electronic control device includes at least one modulation device that generates a decaying alternating current that can be applied to the magnet coil in order to demagnetize at least one of the yoke of the ring body magnet and the valve plate serving as the armature.

8. An apparatus in accordance with claim 7 wherein the valve catcher includes a plurality of concentrically arranged ring bodies with magnet coils, and wherein the magnet coils may be controlled by the control device so that they have either the same polarity or the opposite polarity.

9. A suction valve of plate-type construction comprising a valve seat, a valve plate with valve springs, and an apparatus comprising a valve catcher and an electronic control device, wherein the valve catcher is formed of a ring body that has a ring groove extending in the circumferential direction and also a magnet coil arranged in the ring groove such that the ring body forms a yoke of a ring body magnet of an electromagnet, and wherein the magnet coil is connected to the control device in order to attract the valve plate forming the armature of the electromagnet; and wherein the valve plate and the valve seat are directly placed on top of one another;

wherein the electromagnet is controlled during a control phase by a decaying alternating current such that the valve plate is at least partly demagnetized.

10. A suction valve in accordance with claim 9 wherein a damper plate is arranged between the valve plate and the valve catcher.

11. A suction valve in accordance with claim 10 wherein the damper plate includes a plurality of concentrically extending ring bodies that are all connected together and that are of U-shape at a side facing the valve catcher.

12. A suction valve in accordance with claim 10 wherein the damper plate includes a plurality of concentrically extending ring bodies that are all connected to one another, with at least one ring body consisting of two ring body parts that are separated by a concentrically extending gap.

13. A suction valve in accordance with claim 9 wherein the valve seat, the valve plate and the valve catcher consist of stainless steel.

14. A suction valve in accordance with claim 13 wherein the stainless steel has hard magnetic characteristics.

15. A suction valve in accordance with claim 9 wherein the valve plate consists of a plurality of individual valve plate parts that are of ring-like shape and that are arranged extending concentrically to one another.

16. A piston compressor including an apparatus comprising a valve catcher, a valve plate and an electronic control device, wherein the valve catcher is formed of a ring body that has a ring groove extending in the circumferential direction and also a magnet coil arranged in the ring groove such that the ring body forms a yoke of a ring body magnet of an electromagnet, and wherein the magnet coil is connected to the control device in order to attract the valve plate forming the armature of the electromagnet.

17. A method for the stepless regulation of delivery of a suction valve of a plate-type of construction comprising a valve plate and an electromagnet arranged in a valve catcher, the method comprising:

actuating the valve plate with the electromagnet;

controlling the electromagnet in a first control phase such that the valve plate firmly contacts the valve catcher such that the valve plate is blocked; and controlling the electromagnet in a second control phase by a decaying alternating current such that the valve plate is at least partly demagnetized thus releasing the valve plate.

18. A method in accordance with claim 17 further comprising activating the electromagnet when the valve plate is located in an open state.

19. A method in accordance with claim 18 wherein the electromagnet is only activated or deactivated when the valve plate contacts the valve catcher directly.

20. A method in accordance with claim 17 wherein the electromagnet is controlled such that the valve plate remains open for a predetermined number of cycles of a compressor and is operated free-running over a predetermined number of cycles without the action of the electromagnet.

21. A method in accordance with claim 17 wherein the valve plate consists of a plurality of valve plate parts arranged concentric to one another that are individually or jointly controlled by the electromagnets.

* * * * *